United States Patent [19]

Tsai

[11] Patent Number: 4,887,822

[45] Date of Patent: Dec. 19, 1989

[54] OUTDOOR GAME DART

[76] Inventor: Peter Tsai, Taipei, Taiwan

[21] Appl. No.: 291,622

[22] Filed: Dec. 29, 1988

[51] Int. Cl.[4] ..... A63B 65/02

[52] U.S. Cl. ..... 273/420

[58] Field of Search ..... 273/416, 419–420, 273/423, 417, 428, 398; D21/203

[56] References Cited

U.S. PATENT DOCUMENTS

| | | | |
|---|---|---|---|
| D. 232,649 | 9/1974 | Carlson et al. | D21/203 |
| 2,354,790 | 8/1944 | Beck | 273/417 |
| 2,757,932 | 8/1956 | Shaw | 273/417 |
| 3,596,910 | 8/1971 | Rizzo | 273/420 |
| 3,784,202 | 1/1974 | Pon | 273/417 |
| 3,982,762 | 9/1976 | Milicic | 273/420 |

FOREIGN PATENT DOCUMENTS

| | | | |
|---|---|---|---|
| 2631964 | 1/1978 | Fed. Rep. of Germany | 273/428 |
| 445590 | 4/1936 | United Kingdom | 273/423 |
| 2064967 | 6/1981 | United Kingdom | 273/423 |

OTHER PUBLICATIONS

The Sporting Goods Dealer, 4–1972, p. 18, Toss-'um.

*Primary Examiner*—Paul E. Shapiro

*Attorney, Agent, or Firm*—Fleit, Jacobson, Cohn, Price, Holman & Stern

[57] ABSTRACT

A kind of lawn dart, including a rotatable flight portion and weighted material being located in the front end of head member, to enable dart being able to maintain a steady flight trajectory after having been thrusted, and to enable it being able to restore to vertical state immediately from any oblique position after falling to the ground. The front end of its head member has a sounding member comprising a vibration chamber and a vibration tongue which enables it to give off the sounds accompanied by the air flow having been vibrated following the flight to enhance a fun for playing.

3 Claims, 2 Drawing Sheets

OUTDOOR GAME DART

BACKGROUND OF THE INVENTION

This invention relates to outdoors field game darts and particularly relates to a heavy weighted head member for such darts.

Outdoor field game darts or javelins are well known and are commonly call lawn darts. Such darts are generally similar in structure to indoor game darts but are of a relatively large size. Lawn darts are played on an outdoor field in which a target area is established on the ground and the players throw the darts from a selected distance in order that the darts would fall and thrust in the ground within the target area. Lawn darts must necessarily be strong in structure since they are subject to a large amount of punishment even under normal use; yet they must be simple in structure such that they can be easily and economically manufactured on a commercial scale.

Common lawn darts have a solid metal cylindrical head member for providing the required heavy weight at the front end therein. A pointed metal pin is mounted in the front end of the head member for thrusting into the ground and an elongated metal rod is secured to the rear end of the head member for mounting the flight. The flight is a plastic hollow sleeve having three vanes provided thereon. The sleeve can be slidably engaged over the elongated metal rod to mount the flight on the rod and it is secured in place by a nut mounted on the free end of the metal rod. Such dart has a strong structure and operates satisfactorily. However, it is relatively expensive and time consuming to manufacture which is mainly due to a large amount of metal being required in making the dart. Furthermore, the metal component parts must be made in separate manufacturing steps. Usually, the head member is first formed and then bores are drilled in the center of the front and back ends therein. The pin and the elongated rod are forcibly secured in the respective aores. These component parts may be damaged during such force-fitting resulting in wastage of material. Furthermore, the bores must be accurately formed in order that the pin and the rod can be properly and fixedly secured therein such that they would not become disengaged under the high impact during use.

Another drawback of a metal dart is that the weight of the dart is not concentrated at the head member. This is due to the weight of the elongated metal rod for mounting the flight vanes being almost equal to the head member. Thus, the dart may not provide a desirable trajectory with the pin pointing downward in the falling state of the dart. This results in the dart falling to the ground without the pin thrusting into the ground. This drawback may be overcome by increasing the size of the head member. However, this would invariably increase the bulkiness of the dart and the amount of metal used and, accordingly the total weight of the dark is unnecessarily heavy such that it is hazardous if it accidentally falls upon the players or other persons in the vicinity of the playing area.

A conventional lawn dart without any sounding member can not give off any sound during the process of flight and thus it is unable to provide a further fun for playing. Besides, the conventional lawn darts having a sharp front tip once had ever found to get the people hurt and its safety is to be worried.

In view of that, we still need a kind of outdoors field game darts which can improve the above-mentioned defect and provide a further fun.

SUMMARY OF THE INVENTION

It is a principal object of the present invention to provide a lawn dart which has a sounding member to give off sounds during the flight, not only available to provide a further fun but also available to have an alarming function for the other people.

It is an object of the present invention to provide a lawn dart which has an overall light weight with all its weight concentrated at its head member.

It is another object of the present invention to provide a lawn dart which has a flight portion being capable of producing a counter rotation against the shaft, and is effective to fly steadily and to advance fun for playing.

It is yet another object of the present invention to provide a lawn dart which has a hand-hold portion to allow us holding this lawn dart and thrusting it by our hand very easily.

Outdoor game dart having completed the above-mentioned objects and the other objects unmentioned has an oval head member which has a heavy block therein, and that heavy block can perfectly enable lawn dart at an oblique position to restore to vertical state immediately; on the head member, there are several sounding members which include an air vibration chamber with proper sound intensity, a tongue being located in front of the vibration chamber; as this outdoor game dart is flying, air will flow through its tongue and air vibration chamber to result in air vibrating phenomenon and sounding.

BRIEF DESCRIPTION OF THE DRAWINGS

Other objects of this invention will appear in the following description and appended claims reference being made to the accompanying drawings forming a part of the specification wherein like reference numerals designate corresponding parts in the several views:

DETAILED DESCRIPTION OF THE PREFERRED EMBODIMENT

Figure 1:
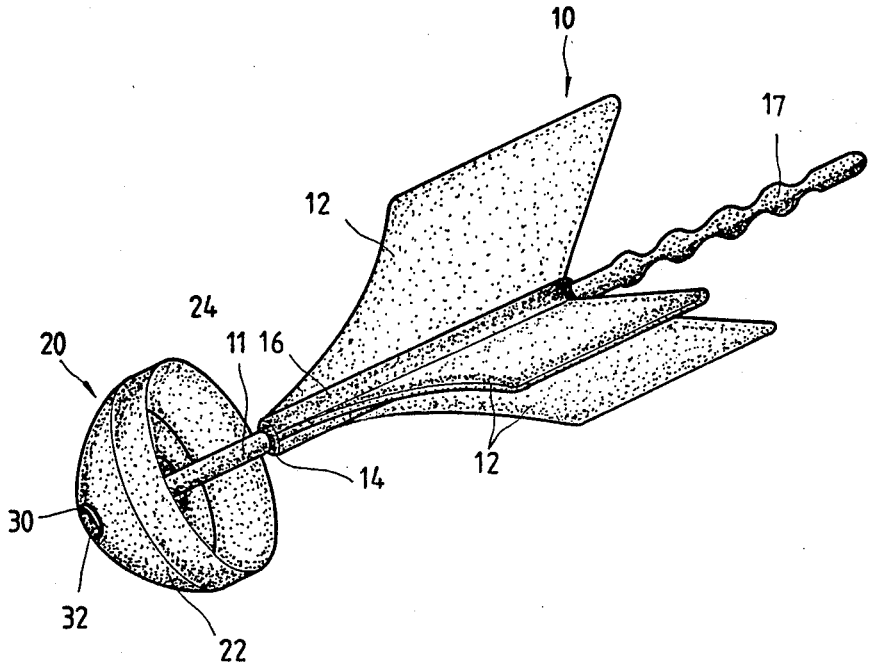
FIG. 1 is a perspective view of the lawn dart according to the present invention.
Figure 2:
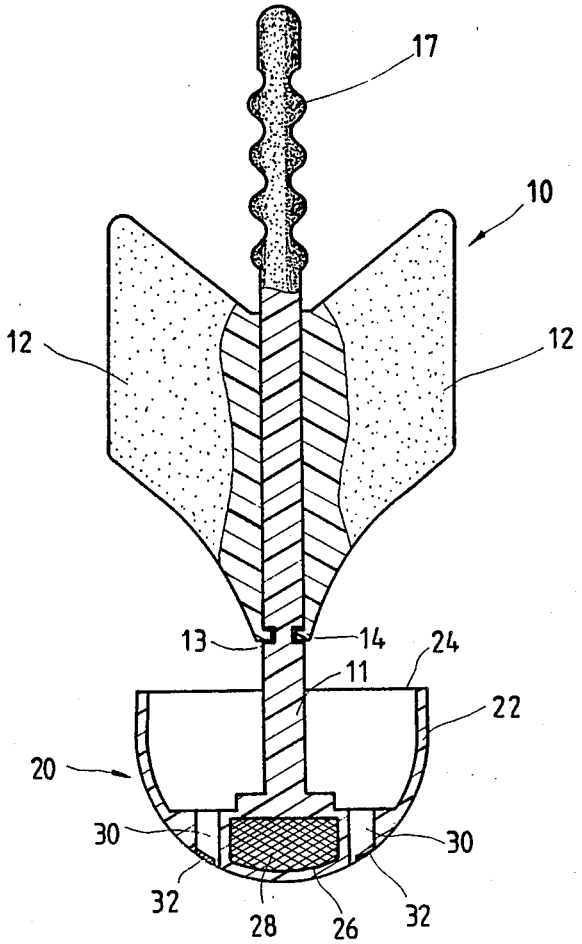
FIG. 2 is a partial cutaway view showing the structure of the head weight member; sounding member and the flight.
Figure 3:
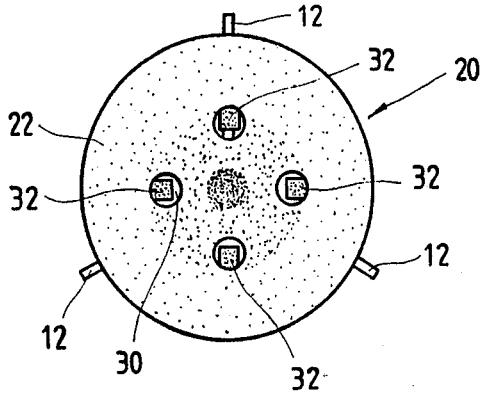
FIG. 3 is a top view thereof.

Regering to the drawings, the preferred embodiment of the dart according to the present invention has a flight portion 10 including an elongated shaft 11 having three flight wings or vanes 12 formed thereon in an evenly spaced manner. Three vanes are shown in this preferred embodiment; however, it can be appreciated than any suitable number of vanes may be used. The flight portion 10 and shaft 11 can produce a counterly rotational relation between each other. Shaft 11 has a ring-shape groove 13 being located at a proper position near the end of head member 20 wherein. While flight portion has a central sleeve portion 16 which can wrap the shaft at liberty and the front rim of the sleeve portion 16 appears an inward ring-shape jut 14; the jut 14 can be perfectly squeezed into ring-shape groove 13 of the shaft; therefore, flight portion 10 is allowed to rotate freely on the shaft 11 but is not allowed to slide.

When the player has thrusted the outdoor game dart, air flow will vibrate flight portion 10 to rotate. which not only can enable dart to fly more steadily but also can add another fun for the players.

The shaft 11 has an elongated rear end portion 17 extending outward beyond the rear ends of the vanes 12. This rear end portion 17 provides a grip on the shaft for the player to hold the dart in playing the game. The rear end portion 17 was made into a wave-shape outlet to accompany player's fingers' shape to enable them more easily to control and hold the shaft 11 in order to advance the accuracy of dart playing.

The front end weighted head member 20 of the dart comprises a substantially semicircular hollwo shell 22 may be made of an impact resistant plastic material and it has a rear pening 24.

The front end of the shell 22 has an enclosed chamber 26 where is filled with a weighted material 28 such as metal powder, pellets, sand or the like.

It will be appreciated that since all the components of the dart of the present invention are made of plastic, the dart has a relatively light overall weight. The combined weight of the plastic components is negligible compared to the weight of the weighting material 28. Thus, the total weight of the dart is entirely concentrated at the front end of the head member 16 and enables the head member 16 to be able to restore to vertical state immediately from any oblique position when the head member 16 is at the end of the trajectory and touching the ground.

The front end of the head member 20 has several sounding members. Each sounding member includes an air vibration chamber 30 with a proper length and a tongue 32 being located in the front end of the air vibration chamber 30. The air flow produced under the way of dart's flight will pass through the tongue 32 and result in a vibrating state, and the vibrating air flow will form an air cyclinder in the vibration chamber 30 to provide a resonance effect for making the sounds like wind instruments. The sounds are given off following the flight of the dart. It thus can provide the player another fun.

While the invention has been particularly shown and described with reference to a preferred embodiment thereof, it will be understood by those skilled in the art that various changes in form and detail may be made therein without departing from the spirit and scope of the invention.

What is claimed is:

1. An outdoor game dart, comprising:

an elongated shaft having a front end and an elongated rear end portion, said shaft has a ring-shape groove near said front end;

a flight portion which can wrap the said shaft and counterly rotate against the said shaft, said flight portion including a plurality of vanes provided thereon and a central sleeve portion, the said sleeve portion has an inward ring-shape jut in the front rim, and the said sleeve portion can be cased on the said shaft at liberty, and the said jut can be curved into the said ring-shape groove perfectly;

a weighted head member mounted at the front end of said shaft, said head member having a substantially semicircular hollow shell, said shell has an enclosed chamber in the front end, said chamber is filled with a weighted material; and a sounding member being located in the front end of said head member, said sounding member including an air vibration chamber with a proper length and a tongue being located in the front end of said vibration chamber, said tongue is vibrated due to their flow passing by.

2. A dart according to claim 1, wherein said shell is made of an impact resistant plastic materials.

3. A dart according to claim 1, wherein said elongated rear end portion is made into a wave-shape surface.

* * * * *